US008251725B2

(12) United States Patent
Kasparian et al.

(10) Patent No.: US 8,251,725 B2
(45) Date of Patent: Aug. 28, 2012

(54) CYLINDRICAL ELECTRICAL CONNECTOR WITH FLOATING INSERT

(75) Inventors: Fredrick J. Kasparian, Cicero, NY (US); Stanley M. Granat, Clay, NY (US); James M. Radka, Marlton, NJ (US)

(73) Assignee: Lockheed Martin Corporation, Bethesda, MD (US)

( * ) Notice: Subject to any disclaimer, the term of this patent is extended or adjusted under 35 U.S.C. 154(b) by 207 days.

(21) Appl. No.: 12/421,319

(22) Filed: Apr. 9, 2009

(65) Prior Publication Data

US 2010/0261361 A1 Oct. 14, 2010

(51) Int. Cl.
*H01R 13/64* (2006.01)

(52) U.S. Cl. ..... 439/252

(58) Field of Classification Search ..... 439/700, 439/816, 729, 823, 244, 319, 739, 246, 252
See application file for complete search history.

(56) References Cited

U.S. PATENT DOCUMENTS

| | | | | |
|---|---|---|---|---|
| 4,033,654 | A | 7/1977 | Ross | |
| 4,289,367 | A | 9/1981 | Everett | |
| 4,655,526 | A | 4/1987 | Shaffer | |
| 4,697,859 | A | 10/1987 | Fisher, Jr. | |
| 4,775,335 | A | 10/1988 | Havel | |
| 4,842,538 | A | 6/1989 | Nochese | |
| 4,963,105 | A | 10/1990 | Lewis et al. | |
| 6,558,177 | B2 * | 5/2003 | Havener et al. | 439/246 |
| 6,749,358 | B2 | 6/2004 | Balsells | |
| 6,942,496 | B2 | 9/2005 | Sweetland et al. | |
| 6,945,790 | B2 | 9/2005 | Sweetland | |
| 6,951,465 | B2 | 10/2005 | Sweetland et al. | |
| D511,366 | S | 11/2005 | Brown | |
| 7,021,957 | B2 | 4/2006 | Sweetland et al. | |
| 7,056,139 | B2 | 6/2006 | Sweetland | |
| 7,077,573 | B2 | 7/2006 | Suh et al. | |
| 7,077,662 | B2 | 7/2006 | Sweetland et al. | |
| 7,077,697 | B2 | 7/2006 | Kooiman | |

(Continued)

FOREIGN PATENT DOCUMENTS

WO 2004031595 A2 4/2004

(Continued)

OTHER PUBLICATIONS

International Search Report dated Jun. 15, 2010 for related application PCT/US2010/030570.

*Primary Examiner* — Vanessa Girardi
(74) *Attorney, Agent, or Firm* — Howard IP Law Group, PC

(57) ABSTRACT

An electrical connector comprising: a conductive housing that contains within an interior of the housing a conductive inner barrel; a low insertion force connector positioned within the inner barrel and having a bore concentrically aligned with a bore of the inner barrel, the housing further comprising: one or more conductive springs disposed circumferentially about the inner barrel and in contact engagement with an interior recessed surface of the inner barrel and the interior of the housing so as to be in electrical contact therewith, wherein the bore of the inner barrel is adapted to receive a conductive pin, the inner barrel being movable both axially and radially via said spring in response to insertion of the conductive pin through the bore and into the low insertion force connector to accommodate off axis orientation of the conductive pin into the connector.

24 Claims, 9 Drawing Sheets

U.S. PATENT DOCUMENTS

| | | | | |
|---|---|---|---|---|
| 7,083,427 | B2 | 8/2006 | Sweetland et al. | |
| 7,094,064 | B2 | 8/2006 | Sweetland et al. | |
| 7,097,495 | B2 | 8/2006 | Sweetland | |
| 7,101,194 | B2 | 9/2006 | Sweetland et al. | |
| 7,125,281 | B2 | 10/2006 | Sweetland | |
| 7,140,916 | B2 | 11/2006 | Sweetland | |
| 7,214,106 | B2 | 5/2007 | Sweetland | |
| 7,223,111 | B2 | 5/2007 | Sweetland | |
| 7,229,327 | B2 | 6/2007 | Zhao et al. | |
| 7,267,027 | B2 | 9/2007 | Bertani | |
| 7,294,020 | B2 | 11/2007 | Zhao et al. | |
| 7,316,593 | B2 | 1/2008 | Balsells | |
| 7,458,862 | B2 | 12/2008 | Zhao et al. | |
| 2006/0083582 | A1 * | 4/2006 | Balsells | 403/325 |
| 2008/0254670 | A1 | 10/2008 | Balsells et al. | |

FOREIGN PATENT DOCUMENTS

| | | | |
|---|---|---|---|
| WO | 2006124969 | A2 | 11/2006 |

* cited by examiner

SECTION B-B

CYLINDRICAL ELECTRICAL CONNECTOR WITH FLOATING INSERT

FIELD OF INVENTION

The present invention relates generally to electrical connectors and is more particularly directed to an electrical connector that compensates for insertion misalignment between two assemblies that pass high current at a low impedance.

BACKGROUND

Numerous electrical connectors use quick connect connectors for conducting current between electrical assemblies. In general, such connectors include a housing, a spring and a lead with the current source provided by the housing. If two electrical assemblies are joined without recourse to being observed by the individual installing the assemblies (e.g. a blind installation), then a degree of flexibility or float between the connectors is required for a reliable connection. Prior art solutions have numerous shortcomings, including but not limited to problems associated with float and alignment concerns, package size and space, and current and resistance requirements, among others. Alternatives to existing connectors are desired.

BRIEF DESCRIPTION OF THE DRAWINGS

Understanding of the present invention will be facilitated by consideration of the following detailed description of the preferred embodiments of the present invention taken in conjunction with the accompanying drawings, in which like numerals refer to like parts, and wherein.

DETAILED DESCRIPTION

It is to be understood that the figures and descriptions of the present invention have been simplified to illustrate elements that are relevant for a clear understanding, while eliminating, for the purpose of clarity, many other elements found in connector technology and methods of making and using each of the same. Those of ordinary skill in the art may recognize that other elements and/or steps may be desirable in implementing the present invention. However, because such elements and steps are well known in the art, and because they do not facilitate a better understanding of the present invention, a discussion of such elements and steps is not provided herein.

In accordance with an aspect of the present invention, an electrical power connector is provided that is capable of carrying high current, for example on the order of between about 10 amps to 105 amps, and having a built-in float to accommodate tolerance build up and reduce insertion force. In an exemplary embodiment, the small connector size and high current capacity enables use of the connector in environments where only a very small volume exists for mating two modules. According to an embodiment of the present invention, a single pin connector (rather than multi-pin current carrying connectors that undesirably increase assembly size and integration/connection constraints) provides a high current carrying capacity and a floating connector within a relatively small package. The connector easily solders to a bus bar or printed circuit board (PCB), thereby minimizing use of board space. The power connector may be entirely conductive and provides a simple mechanical construction which allows for short, low resistance path from high current power supplies directly to power amplifiers for various applications, such as pulsed radar systems. The electrical power connector also permits construction flexibility by using a machined pin for power amplifier input.

Figure 1A:
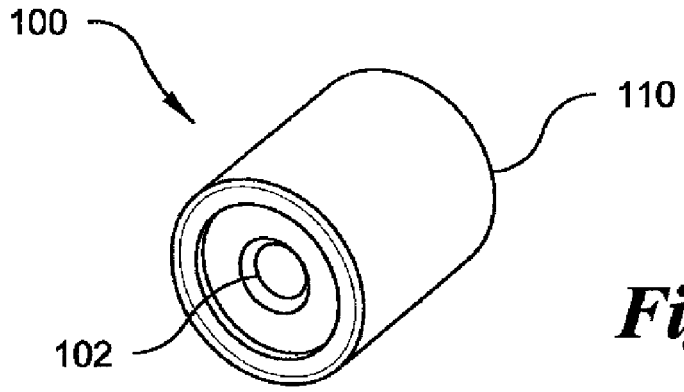
FIG. 1*a* is a perspective view of an electrical connector according to an embodiment of the present invention.
Figure 1B:
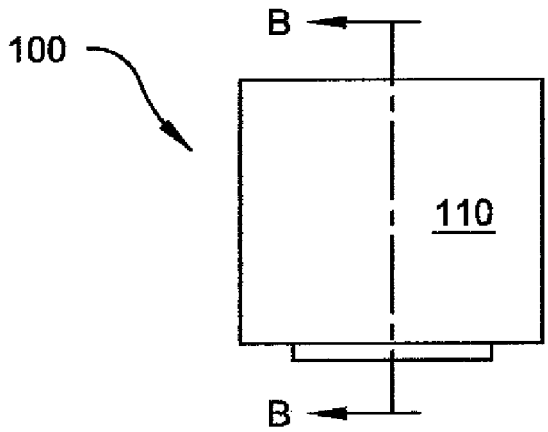
FIG. 1*b* is an elevation view of the electrical connector according to an embodiment of the present invention.
Figure 1C:
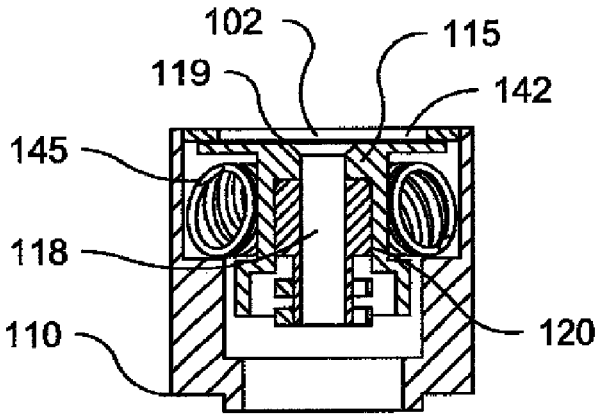
FIG. 1*c* is a cross section along lines B-B of the electrical connector according to an embodiment of the present invention.
Figure 3:
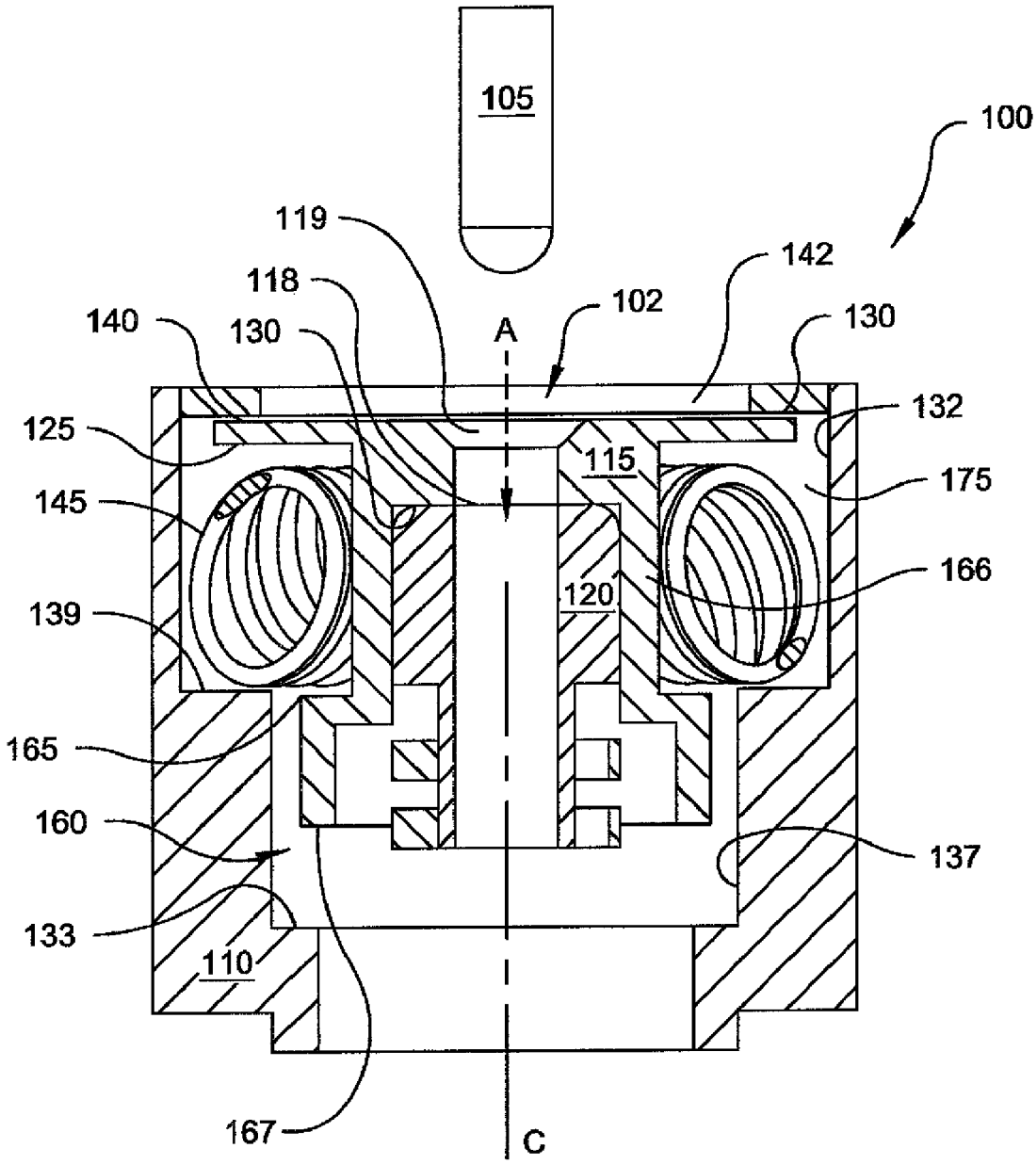
FIG. 3 is a more detailed cross section of the electrical connector according to an embodiment of the present invention.

FIG. 1*a* is a perspective view of an electrical connector 100 according to an embodiment of the present invention. In one embodiment the housing comprises a conductive outer barrel 110 that conducts current when conductive pin 105 (FIG. 3) of an associated electronic assembly is inserted into a female pin socket or receptacle 102 contained within the housing. FIG. 1*b* shows a side elevation view of electrical connector 100 designating cross section B-B referred to in FIG. 1*c*. As shown in FIG. 1*c*, the electrical connector 100 contains within its outer housing 110 a conductive inner barrel 115 and a low insertion force connector 120 electrically coupled with inner barrel 115. Low insertion force connector 120 includes a through hole or bore 118 concentrically aligned with through hole or bore 119 of the inner barrel 115 for receiving the conductive pin 105 (FIG. 3). The conductive pin is sized to slidingly engage the interior surfaces of the bores so as to be in conductive contact with the inner barrel and low insertion force connector. The bore 119 of inner barrel 115 may have a countersunk taper to guide the end of the off center pin 105. The pin can exert a radial force that aligns the pin 105 and the bore 119.

Figure 2:
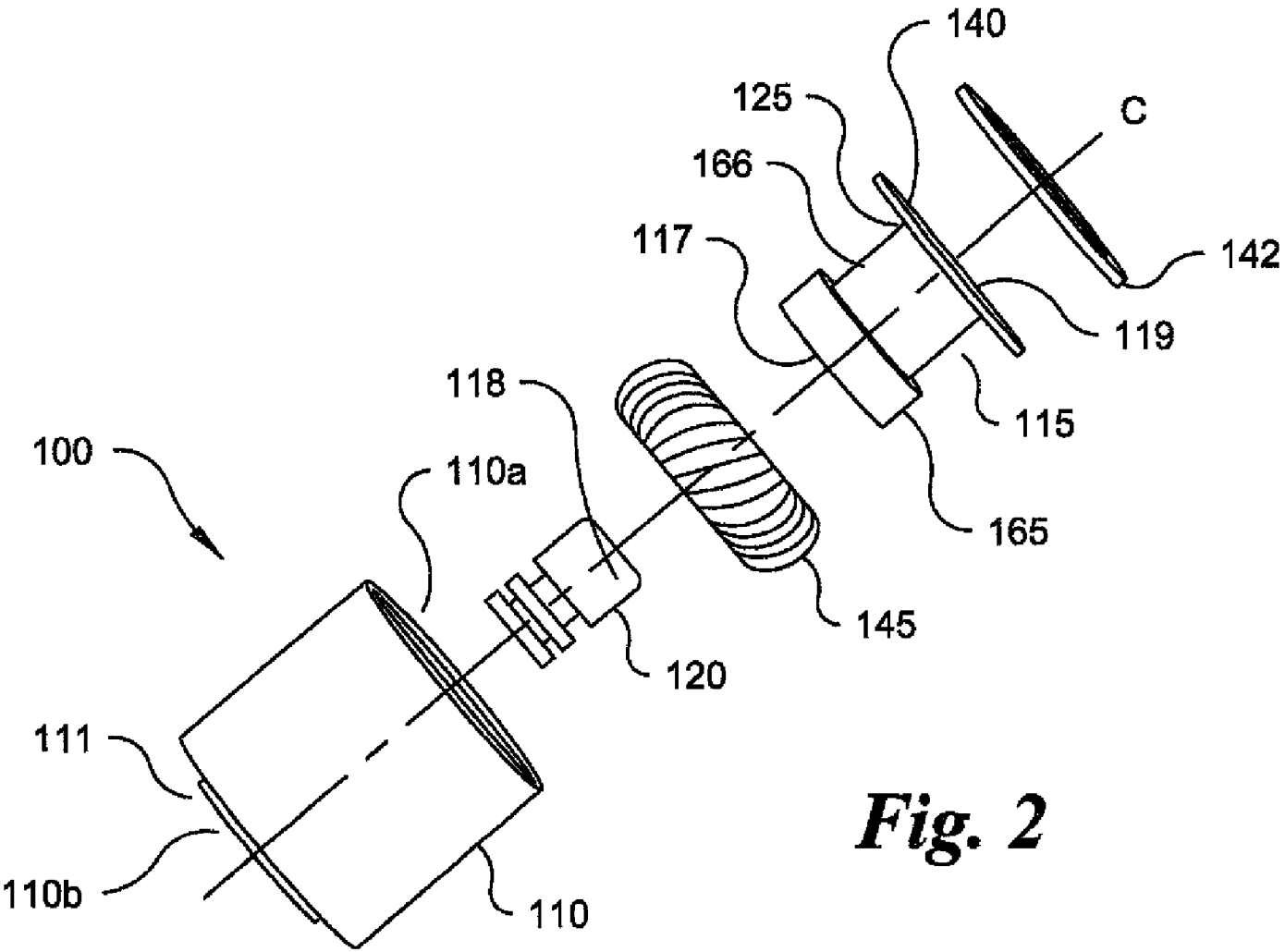
FIG. 2 is an exploded view of the electrical connector of FIG. 1*a*-1*c* according to an embodiment of the present invention.

As best shown in FIG. 2, in one configuration, the inner barrel 115 takes the form of a spool having a recessed conductive outer surface 166 positioned between fore and aft ends, with disk shaped fore end having top surface 140 and lower surface 125, and aft end having shoulder portion 165. A canted spring 145 is disposed circumferentially about the recessed conductive outer surface 166 of inner barrel 115. The canted spring provides electrical conductivity between the conductive outer barrel 110 and conductive inner barrel 115 and conductive pin 105 (FIG. 3), and also permits a degree of lateral (e.g. radial) and axial movement when the pin is in an angular orientation with respect to the bore 118 of the low insertion force connector 120. The connector 100 allows for off axis, referred to as one or more of axial, radial or lateral float, of the pin 105 (FIG. 3) upon pin insertion into connector 100 through selectable connector dimensions and spring 145 combinations. The outer barrel 110 is fixed to a conductor such as printed circuit clad from which it conducts current and remains mechanically fixed relative to the movable inner barrel 115.

Figure 5A:
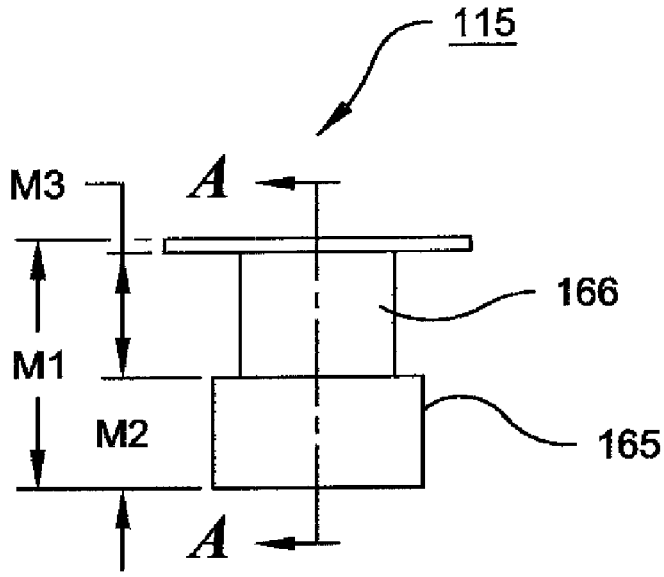
FIG. 5*a*-5*b* depict side and cross section views, respectively, of an exemplary conductive inner barrel configuration.
Figure 5B:
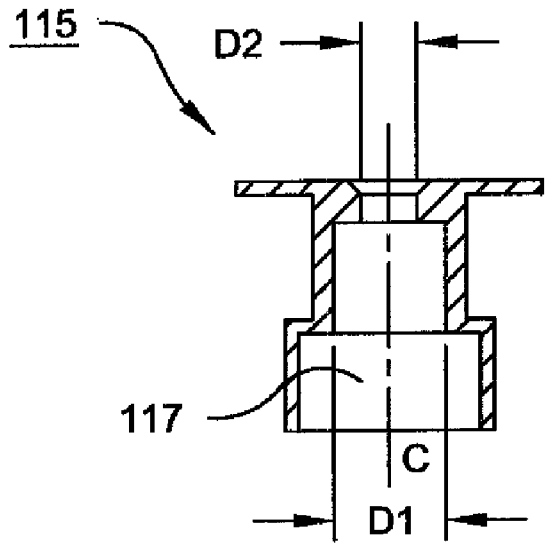

In the exploded view of FIG. 2, it can be seen that conductive outer housing 110 has an opening 110*a* for receiving conductive inner barrel 115. The inner barrel 115 receives low insertion force connector 120 via opening 117. Connector 120 may be of the type such as model number LR062 commercially available from Tribotek Inc., Burlington, Mass. The low insertion force connector 120 is capable of delivering high currents, while maintaining a stable performance even with misalignment of the conductive pin 105 (FIG. 3). The inner barrel 115 top surface 140 is captured by a retaining ring 142. Ring 142 may optionally be manufactured from a conductive material. In one embodiment the retaining ring 142 is manufactured from Copper Tellurium although other suitable metals or materials may be employed FIG. 5*a*-5*b* show an exemplary embodiment of the conductive inner barrel 115 depicted in FIG. 2. As shown therein, inner barrel 115 has a height M1, shoulder 165 has a height M2, and recessed conductive outer surface 166 has a height M3. Height M3 provides the height of the canted spring 145 (FIG. 2). The relative dimensions between the inner barrel 115 and the outer barrel 110 establish the mechanical limit stops to prevent over travel damage to the canted spring 145 during pin insertion and removal and excessive motion between the assembly carrying the pin and the assembly carrying the socket subassembly. The interior of inner barrel 115 is adapted so as to accommodate the low insertion force connector. As best shown in FIG. 5*b*, opening 117 has a diameter D1 sized to accommodate insertion of connector 120 (FIG. 2). The interior of inner barrel 115 is configured so that low insertion force connector 120 can be press fit into the inner cavity along the central axis C and engages the interior walls of the barrel and is retained therein. The diameter D2 of the bore that receives the pin connector shown in FIG. 3 is substantially equal to that of the low insertion force connector 120, as described herein and as shown for example, in FIG. 1*c* and FIG. 3. In one embodiment, the electrical connector inner barrel is configured according to the following: M1=8.81 millimeters (mm); M2=3.84 mm; D2=1.83 mm; and D1=4.19 mm.

Figure 6A:
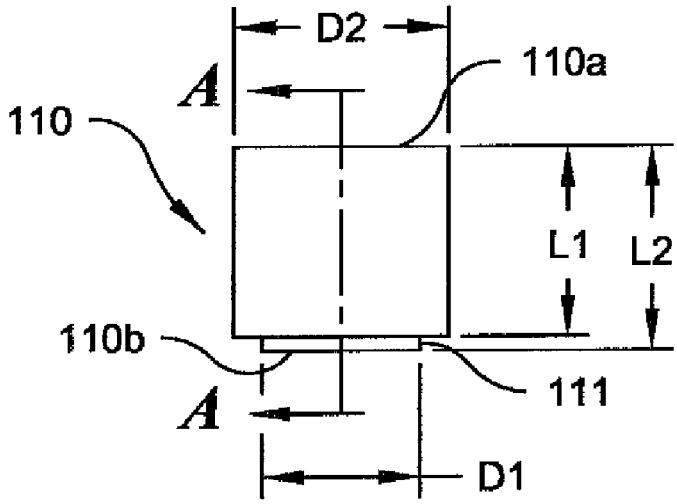
FIG. 6*a*-6*b* depict side and cross section views, respectively, of an exemplary conductive outer barrel configuration.
Figure 6B:
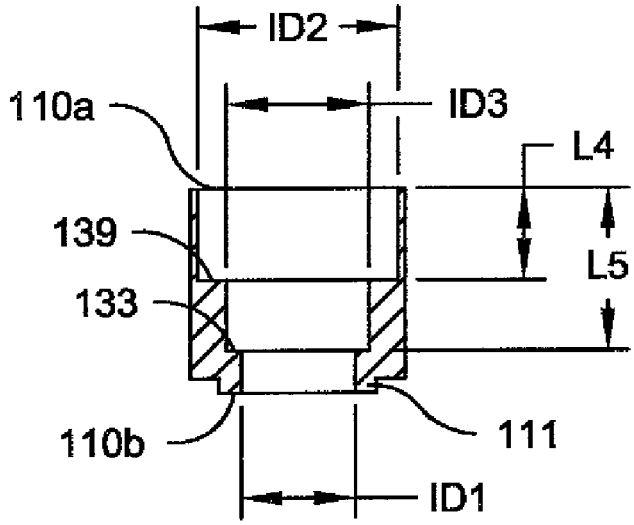

FIG. 6*a*-6*b* show an exemplary embodiment of the conductive outer barrel 110 depicted in FIG. 2. As shown therein, outer barrel 110 has a height given by L2. The height of the lip portion 111 at the aft end of the outer barrel 110*b* is given by the computation of L2−L1. The aft end outer and inner diameters of the conductive outer barrel are identified as D1 and ID1, respectively. At the fore end, outer and inner diameters of opening 110*a* are identified as D2 and ID2, respectively. The inner diameter 1D3 is associated with shoulder portion 133 of the conductive outer barrel and has a value between ID1 and ID2. L4 represents the height from shoulder 139 to opening 110*a*. L5 represents the height from shoulder 133 to opening 110*a*. Opening 110*a* has an inner diameter ID2 adapted so as to accommodate the inner barrel 115 as described herein and as shown for example, in FIG. 1*c* and FIG. 3. In one embodiment, the electrical connector outer barrel is configured according to the following: L1=11.44 mm, L2=12.2 mm, L4=5.57 mm, L5=9.58 mm, D1=8.6 mm, D2=12.83 mm, ID1=7.08 mm, ID2=11.83 mm, ID3=8.6 mm.

Figure 9A:
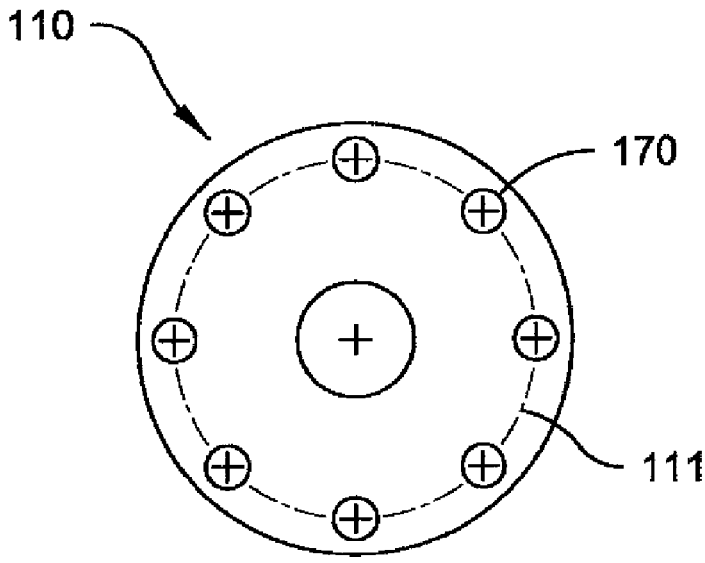
FIG. 9*a*-9*b* depict side and cross section views, respectively, of an exemplary conductive outer barrel configuration.
Figure 9B:
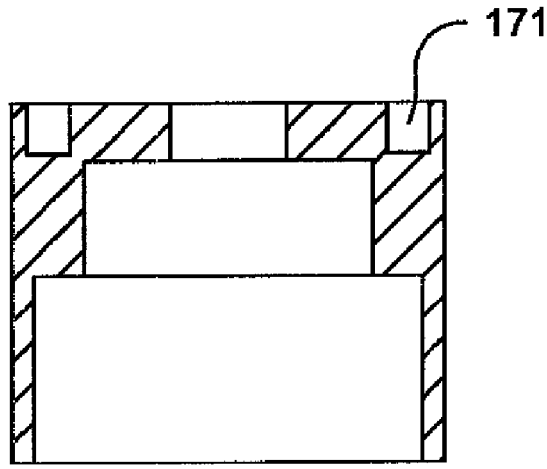

FIG. 9*a*-9*b* show an alternative exemplary embodiment of the conductive outer barrel 110 depicted in FIG. 2. As shown therein, lip portion 111 of the embodiment shown in FIG. 6*a*-6*b* has been replaced by one or more pins 170. A channel 171 may be formed within outer barrel 110 for attaching pins 170 to outer barrel 110.

Referring again to FIG. 3, in one embodiment spring 145 is shaped into a coil with respect to the central axis C and the internal envelope defines a chamber or annular space 175 (see FIG. 3) about the central axis designated as "C". The spring may be one single coiled spring or a multiplicity of springs, each with its own retaining groove. With reference to FIG. 2, and FIG. 3, canted coil spring 145 slips over a shoulder or lower boss 165 of the inner barrel to retainingly fit about recessed cylindrical outer surface 166. Spring 145 rests on interior surface or first shoulder 139 (FIG. 3) of outer barrel housing 110 within the annular space 175 (FIG.3). In a relaxed state, inner barrel shoulder 165 is substantially planar with outer barrel first shoulder 139. As shown, the structure provides for both lateral and axial float within the conductive outer barrel housing. Inner barrel lower surface 125 and recessed surface 166 is contacted by spring 145 when the inner barrel is depressed (e.g. by off axis insertion of pin 105 into the socket 102) and enables the inner barrel 115 the requisite axial and lateral degrees of freedom to move in those directions in response to insertion of pin 105.

Figure 4A:
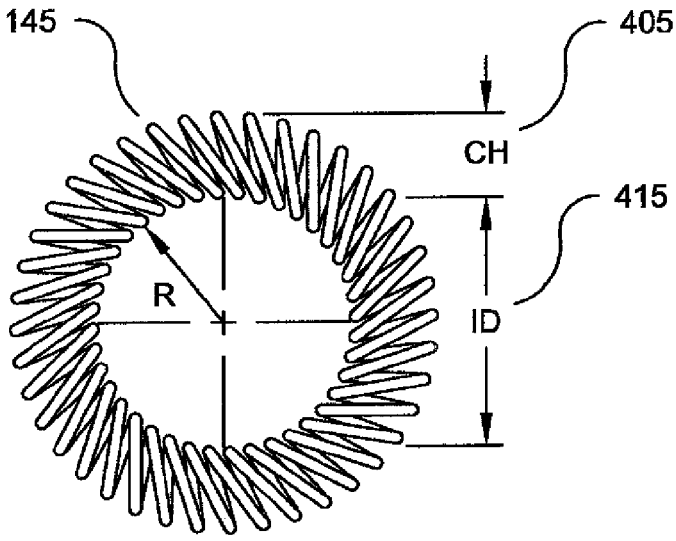
FIG. 4*a*-4*b* show two views, respectively, of a canted spring to conduct current and permit movement of the socket during insertion of the male conductive pin according to an aspect of the present invention.
Figure 4B:
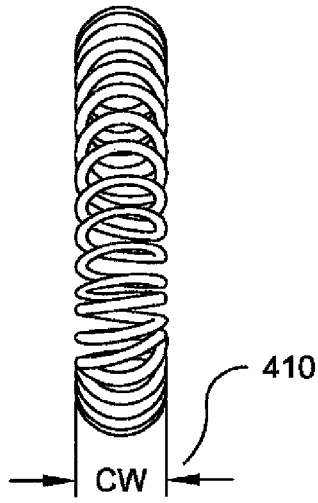

With reference to FIG. 3, FIG. 4*a*, and FIG. 4*b*, the spring 145 cant orientation is along radial lines such that its compression forces manifest in spring flexure generally perpendicular to the radius R. The radial configuration of the spring provides nearly constant force or uniform loading around the entire perimeter of the interior recessed cylinder surface 166, providing a wide range of working deflections and allowing the spring to compensate for large mating tolerances over wide temperature variations. It is understood that the circumference of the ring in the radial direction exceeds that of the fore and aft sections of the inner barrel so as to provide flexation along the inner wall surface 132 of the outer barrel housing in response to lateral forces. The spring material may be, in one embodiment, gold plated, in accordance with ASTM specification B488, over a Zirconium Copper alloy to provide for high current applications. Other suitable metals may be employed. In an exemplary embodiment, the small size of the electrical connector is realized by a spring coil having in its natural state a coil height (CH) 405, coil width (CW) 410 and spring internal diameter (ID) 415 of about 0.150 inch (in.), 0.160 inch and 0.220 inch, respectively. The canted coil spring 145 may be of the type such as model number X565099 commercially available from Bal Seal of Foothill Ranch, Calif.

Returning again to the sectional view of the embodiment of FIG. 3, pin 105 slidingly penetrates pin socket 102 to establish electrical contact with the connector 100 contact surface 140. The surface 140 is in electrical contact with conductive outer barrel 110, which is in electrical contact with the interior of the housing inner barrel 115 and low insertion force connector 120, and further in electrical contact with spring 145. Connector 100 is solderable, brazeable, or attachable (e.g. press) fit into one of an electrical bus bar, printed circuit clad or other device where an electrical connection may be required. Alternatively, one may replace the lip with a multiplicity of pins which can be attached by any of the above methods.

With reference to FIG. 3, the housing inner barrel 115 is permitted to move within limits axially and radially within the barrel housing 110 as provided for by chamber 160 and chamber 175. The retaining ring 142 and inner surface 132 of the outer barrel housing defines an upper hard stop 130 that prevents inner barrel 115 from traveling axially beyond the retaining ring 142 (i.e. in the vertical direction of FIG. 3 opposite the arrow A). The inner barrel 115 is prevented from traveling radially beyond the inner surface 132 of the outer barrel housing, providing a radial hard stop. When the inner barrel 115 is moved axially in a downward direction (i.e. in the direction represented by the arrow of pin 102 in FIG. 3) lower surface 125 of inner barrel 115 is urged against and contacts the spring 145. Spring 145 is compressed during the downward axial movement of the housing upon insertion of the pin. The terminal end 167 of shoulder 165 has an outer diameter exceeding the inner diameter ID1 of the outer barrel. This operates as a lower hard stop that prevents inner barrel 115 from traveling axially downward beyond outer barrel second shoulder 133. The inner barrel 115 is also prevented from traveling radially or laterally beyond the inner surface 137 of the outer barrel housing, providing yet another hard stop.

Figure 7:
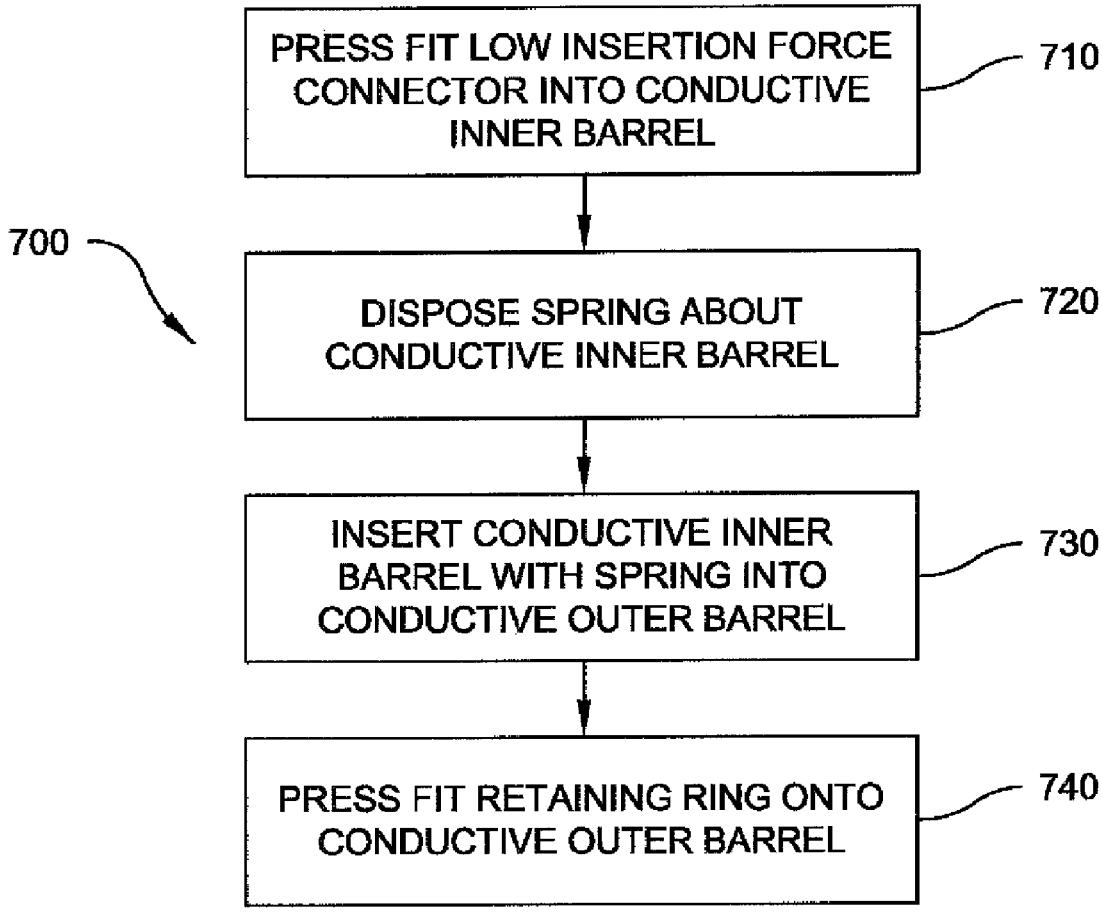
FIG. 7 is a flow chart of a method of assembly for an electrical connector according to an embodiment of the present invention.

FIG. 7 shows a method 700 for assembling electrical connector 100. With reference to FIGS. 2, 3 and 6, the method of assembly includes the steps of: (1) press fitting (step 710) the fore end represented by opening 118 of the low insertion force connector 120 into the opening 117 of inner barrel 115 until connector 120 contacts shoulder 170 and mates with 130 (see FIG. 3); (2) disposing (step 720) spring 145 over the inner barrel 115 shoulder 165 to lodge it circumferentially about recessed conductive outer surface 166 of inner barrel 115; (3) inserting (step 730) the inner barrel 115 and spring 145 into opening 110*a* of outer barrel housing 110 until spring 145 contacts shelf 139 (see FIG. 3); (4) and press fitting (step 740) retaining ring 142 having an opening to accept the conductive pin 105 into the outer barrel housing 110 until flush to the connector front face.

Figure 8:
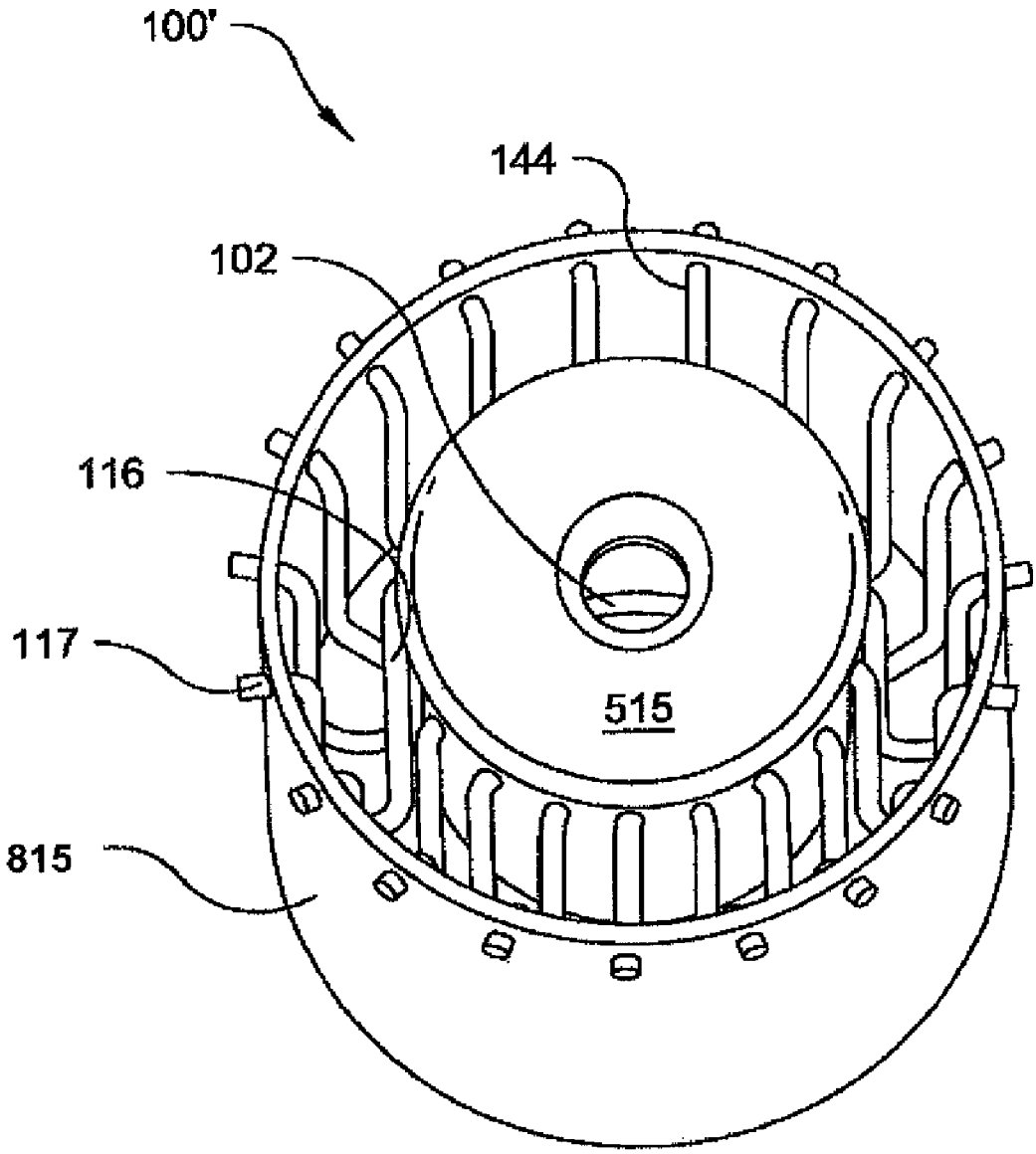
FIG. 8 is an alternate embodiment of an electrical connector according to an embodiment of the present invention.

FIG. 8 illustrates an alternate embodiment of a electrical connector configuration that compensates for the misalignment between two assemblies manifested in an axial, radial or lateral float, on insertion of the pin 105 (FIG. 3) into the connector for passing high current at a low impedance. With further reference to FIGS. 2, 3 the electrical connector 100' may alternately employ a conductive inner barrel 515 that fits into a conductive housing or other conductive outer barrel 815. In addition, conductive inner barrel 515 serves to accept low insertion force connector 120 (FIG. 2) with an interior chamber thereof. Inner barrel 515 is cooperatively joined to outer barrel 815 through a plurality of circumferentially aligned conductive springs 144. In one embodiment, conductive springs 144 are generally U-shaped and couple through respective longitudinal spring ends aligned with corresponding longitudinal conductive slots on the outer barrel 815. Terminal ends 116,117 of each of the springs 144 join the outer barrel 815 to the inner barrel 515 and also permit a degree of lateral (radial) and axial movement of the inner barrel 515 with respect to the outer barrel 815 when the pin 105 (FIG. 3) as inserted into pin socket 102 is in an angular misalignment with respect to the through hole or bore of the low insertion force connector via pin socket 102. Springs 144 disposed circumferentially about the inner barrel 515, also provide for conductive contact between the outer barrel 815 and the inner barrel 515 such that when the pin 105 (FIG. 3) is inserted into pin socket 102 electrical contact is established between the pin 105 and the low insertion force connector.

While the present invention has been described with reference to the illustrative embodiments, this description is not intended to be construed in a limiting sense. Various modifications of the illustrative embodiments, as well as other embodiments of the invention, will be apparent to those skilled in the art on reference to this description. It is therefore contemplated that the appended claims will cover any such modifications or embodiments as fall within the true scope of the invention.

What is claimed is:

1. An electrical connector comprising:

a conductive housing having a proximal end and a distal end, the conductive housing having an interior surface defining a shoulder portion;

a conductive inner barrel contained within the conductive housing, the conductive inner barrel having a first end proximal the proximal end of the conductive housing, and a second end opposite the first end, the first end comprising a flange portion, said conductive inner barrel having a height that is less than a height of said conductive housing and wherein said conductive inner barrel is configured to fit entirely within an interior of the housing;

a low insertion force connector positioned within the conductive inner barrel and having a bore concentrically aligned with a bore of the conductive inner barrel;

one or more conductive springs disposed circumferentially about the inner barrel and between the first end flange portion and the interior shoulder portion of said housing and in contact engagement with an exterior recessed surface of the inner barrel and the interior of the housing so as to be in electrical contact therewith, the second end of the inner barrel positioned aft of said shoulder portion, wherein the bore of the inner barrel is adapted to receive a conductive pin, the inner barrel being movable both radially and axially via said spring in response to insertion of the conductive pin at the first end through the bore and into the low insertion force connector to accommodate off axis orientation of the conductive pin into the connector.

2. A method comprising the steps of:

press fitting a conductive low insertion force connector into a conductive spool shaped inner barrel until the inner barrel contacts a limiting surface;

disposing a canted spring circumferentially about a central recessed area of said spool shaped inner barrel;

inserting the inner barrel with spring into a conductive outer housing; and press fitting a conductive outer retaining ring into the conductive outer housing, wherein said retaining ring, said conductive outer housing, said spring, said inner barrel and said low insertion force connector are in electrical contact with one another.

3. An electrical connector comprising:

a conductive housing that contains within an interior of the housing a conductive inner barrel having a first end and a second end opposite the first end, the first end comprising a flange portion, said conductive inner barrel having a height that is less than a height of said conductive housing and wherein said conductive inner barrel is configured to fit entirely within the interior of the housing;

a low insertion force connector positioned within the inner barrel and having a bore concentrically aligned with a bore of the inner barrel, the housing further comprising:

one or more conductive springs disposed circumferentially about the inner barrel and between the first end flange portion and an interior shoulder of said housing and in contact engagement with an exterior recessed surface of the inner barrel and the interior of the housing so as to be in electrical contact therewith, wherein the bore of the inner barrel is adapted to receive a conductive pin, the inner barrel being movable both radially and axially via said spring in response to insertion of the conductive pin at the first end through the bore and into the low insertion force connector to accommodate off axis orientation of the conductive pin into the connector.

4. The electrical connector according to claim 3, wherein the spring is canted in a circumferential direction.

5. The electrical connector according to claim 3, wherein the spring provides a counterforce when laterally deflected by the insertion of the conductive pin.

6. The electrical connector according to claim 3, wherein the spring is plated with a conductive coating.

7. The electrical connector according to claim 3, wherein the connector is electrically and mechanically connected to a conductor.

8. The electrical connector according to claim 3, wherein the electrical connector allows for lateral float of the conductive pin on insertion to the electrical connector through selectable connector sizes and spring combinations.

9. The electrical connector according to claim 3, wherein the conductive housing further includes an inner shoulder portion adapted to block the conductive inner barrel from traveling axially aft of said shoulder.

10. The electrical connector of claim 3, wherein said conductive pin, said outer conductive housing, said inner barrel and said one or more conductive springs are all configured to be in electrical contact with one another.

11. The electrical connector according to claim 3, wherein the spring is a single conductive wire.

12. The electrical connector according to claim 11, further including a retaining ring secured to an end of the conductive housing to contain the conductive inner barrel.

13. The electrical connector according to claim 12, wherein the spool shaped inner barrel first end is proximal to the retaining ring and has a first diameter; and the second distal end has a second diameter, the first diameter of the proximal end being greater than the second diameter of the distal end.

14. The electrical connector according to claim 3, wherein the inner barrel is moveable relative to the conductive housing.

15. The electrical connector according to claim 14, wherein the conductive housing is fixed and wherein the conductive inner barrel is configured to move coaxially with respect to the fixed conductive housing.

16. The electrical connector according to claim 15, further including one or more stops to prevent over travel of the inner barrel with respect to the conductive housing.

17. The electrical connector according to claim 3, wherein the spring is shaped into a toroidal coil spring and disposed within an annular space defined by said first end flange portion of said conductive inner barrel and said conductive housing.

18. The electrical connector according to claim 17, wherein the spring conforms to the annular space by spring flexure.

19. The electrical connector according to claim 17, wherein the conductive housing has a fore end for receiving the inner barrel, and an aft end, the fore end having an inner diameter greater than that of the aft end.

20. The electrical connector according to claim 17, wherein the second end of the inner barrel comprises a shoulder portion, the first end flange portion, exterior recessed surface, and second end shoulder portion defining a spool shaped inner barrel.

21. An electrical connector comprising:

a conductive housing that contains within an interior of the housing a conductive inner barrel coupled and in electrical contact with the conductive housing through a plurality of circumferentially aligned conductive springs;

a low insertion force connector positioned within the conductive inner barrel and having a bore concentrically aligned with a bore of the conductive inner barrel, the plurality of conductive springs disposed circumferentially about the inner barrel and in engagement with the outer barrel so as to be in electrical contact therewith, wherein the bore of the inner barrel is adapted to receive a conductive pin, the inner barrel being movable both axially and radially via said springs in response to insertion of the conductive pin through the bore and into the low insertion force connector to accommodate off axis orientation of the conductive pin into the connector, wherein the plurality of springs comprise a plurality of conductive U-shaped springs.

22. The electrical connector according to claim 21, wherein the U-shaped springs couple via respective longitudinal spring ends aligned with corresponding conductive slots.

23. The electrical connector according to claim 22, wherein the U-shaped springs have terminal ends that join the outer barrel to the conductive inner barrel.

24. The electrical connector according to claim 21, wherein the conductive inner barrel cooperatively joins to the conductive housing via the plurality of conductive U-shaped springs.

* * * * *